US005577664A

United States Patent [19]

Heitzman

[11] Patent Number: 5,577,664

[45] **Date of Patent: *Nov. 26, 1996**

[54] SHOWER HEAD WITH VARIABLE FLOW RATE, PULSATION AND SPRAY PATTERN

[76] Inventor: Charles J. Heitzman, 4340 Pahoa Ave., Honolulu, Hi. 96816

[ * ] Notice: The term of this patent shall not extend beyond the expiration date of Pat. No. 5,397,064.

[21] Appl. No.: 403,270

[22] Filed: Mar. 13, 1995

Related U.S. Application Data

[63] Continuation of Ser. No. 139,001, Oct. 21, 1993, Pat. No. 5,397,064.

[51] Int. Cl.[6] ..... B05B 1/08; B05B 15/00

[52] U.S. Cl. ..... 239/99; 239/446; 239/570; 239/533.13; 239/602; 239/546

[58] Field of Search ..... 239/570, 99, 436, 239/443, 444, 446, 533.13, 546, 602

[56] References Cited

U.S. PATENT DOCUMENTS

| | | | |
|---|---|---|---|
| 2,761,738 | 9/1956 | Swan | 239/383 |
| 2,862,766 | 12/1958 | Ward | 239/562 |
| 3,130,919 | 4/1964 | Baker | 239/602 X |
| 3,473,736 | 10/1969 | Hietzman | 239/101 |
| 3,568,716 | 3/1971 | Heitzman | 239/381 X |
| 3,719,328 | 3/1973 | Hindman | 239/546 |
| 3,762,648 | 10/1973 | Deines et al. | 239/381 |
| 4,010,899 | 3/1977 | Heitzman | 239/383 X |
| 4,101,075 | 5/1978 | Heitzman . | |
| 4,190,207 | 2/1980 | Fienhold et al. | 239/381 |
| 4,346,894 | 8/1982 | Harmony | 239/381 |
| 4,478,367 | 10/1984 | Petursson | 239/381 |
| 4,522,232 | 6/1985 | Ferguson | 239/562 |
| 4,577,284 | 4/1986 | Arnold | 239/381 |
| 4,588,130 | 5/1986 | Trenary et al. | 239/381 |
| 5,172,862 | 12/1992 | Hiermann et al. | 239/546 X |

FOREIGN PATENT DOCUMENTS

| | | | |
|---|---|---|---|
| 3300469 | 7/1984 | Germany | 239/101 |

*Primary Examiner*—Kevin Weldon
*Attorney, Agent, or Firm*—Jacox, Meckstroth & Jenkins

[57] ABSTRACT

A shower head includes a housing enclosing a first rotary valve member driven by a turbine wheel and gear reducer for cycling the flow rate through the housing between high and low flow rates, and a manually rotatable cross valve shaft provides for selecting the degree of cycling. A second rotary valve member is combined with a second turbine wheel for pulsating the cycling flow rate, and further rotation of the valve shaft provides for hydraulically shifting and stopping the second valve member for bypassing the pulsation to provide a full continuous water flow. Water is discharged from the shower head through flexible tubes arranged in groups which are twisted in response to rotation of a control ring for selecting a spray pattern between a tight penetrating pattern and a wide full pattern.

15 Claims, 2 Drawing Sheets

SHOWER HEAD WITH VARIABLE FLOW RATE, PULSATION AND SPRAY PATTERN

This is a continuation of application Ser. No. 08/139,001, filed Oct. 21, 1993, now U.S. Pat. No. 5,397,064.

BACKGROUND OF THE INVENTION

The present invention relates to a pulsating fluid spray device or shower head of the general type disclosed in U.S. Pat. No. 3,473,736, No. 3,568,716 and No. 4,101,075 which issued to applicant. The shower heads disclosed in these patents provide for pulsating the water stream discharge from the shower head and for manually selecting between full pulsation and no pulsation or a continuous water spray. After extensive testing and use of known pulsating shower heads, it has been found desirable to provide for cycling the flow rate through the shower head between a low flow rate and a high flow rate to provide for not only water savings but also for the different sensations of a changing flow rate. When the cycling at the flow rate is used in combination with pulsation, the cycling pulsation between low and high frequency cooperates with the cycling between minimum and maximum flow rate to provide for an improved massaging action which is more desirable than a constant speed pulsation. It has also been found desirable for a pulsating shower head to provide for infinitely adjusting the spray pattern between a tight or concentrated and more penetrating pattern and a wide spray or full pattern which provides for more delicate pulsating action.

SUMMARY OF THE INVENTION

The present invention is directed to an improved water spray device or shower head which provides all of the desirable features mentioned above, and which features may be selected separately or in combination. More specifically, the shower head of the present invention provides for selecting an automatic cycling feature when the flow rate cycles between a high or full flow rate and a low flow rate to provide for a different sensation as well as a significant water savings, for example, up to 25%. This cycling flow rate may also be used in combination with the feature of pulsation which may be selected between low and high frequencies or full pulsation may be selected without cycling. In addition, the shower head of the invention provides for infinitely adjusting the spray pattern between a tight and more concentrated penetrating pattern and a full wide spray pattern, depending upon the water action desired.

In general, the above features are provided by shower head which includes a housing enclosing and supporting a first rotary valve member driven by a turbine wheel and a gear reducer for automatically cycling the flow rate through the shower head between high and low rates, and a manually rotatable cross valve shaft provides for selecting the degree of cycling. A second rotary valve member is formed as part of a second turbine wheel for pulsating the cycling flow rate, and further rotation of the cross valve shaft provides for hydraulically shifting and stopping the second valve member for bypassing the water pulsation when a continuous spray discharge is desired. A plurality of rotatable water discharge caps support the outer ends of groups of flexible tubes to provide for discharging water streams from the shower head, and the caps are rotated in unison in response to rotation of a control ring for slightly twisting the flexible tubes to select a spray pattern between a tight penetrating pattern and a wide full range pattern.

Other features and advantages of the invention will be apparent from the following description, the accompanying drawings and the appended claims.

DESCRIPTION OF THE PREFERRED EMBODIMENT

Figure 1:
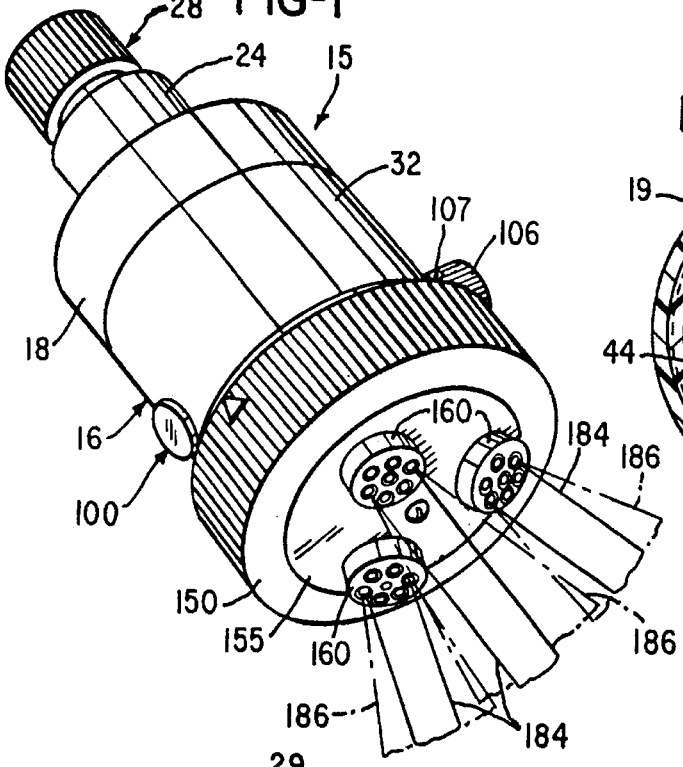
FIG. 1 is a perspective view of a shower head constructed in accordance with the invention.
Figure 3:
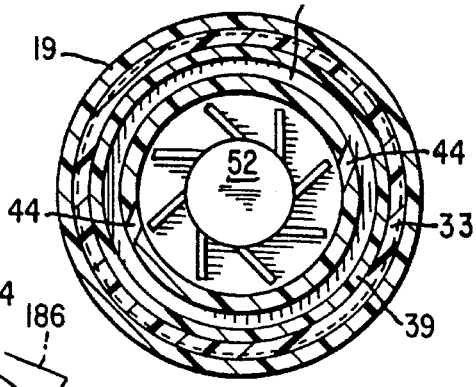
FIG. 3 is a section taken generally on the line 3—3 of FIG. 2.

FIG. 1 illustrates a shower head 15, the parts of which are primarily molded of rigid plastics material. The head 15 includes a generally cylindrical housing 16 which has a decorative outer surface such as a chrome plating. The housing 16 includes an upper annular cap section 18 having an internally threaded lower portion 19 and an externally threaded upper tubular neck portion 22 for receiving an internally threaded collar 24. Part-spherical surfaces are formed on the neck portion 22 and the collar 24 for engaging the spherical lower portion 27 of a tubular fitting 28 to provide a universal swivel connection between the housing 16 and the fitting 28. The fitting 28 is preferably formed of metal and has an upper portion 29 with straight knurls and internal threads for attaching the fitting to a water supply line.

The housing 16 also includes a cylindrical intermediate section 32 which has a reduced upper annular portion 33 with external threads for receiving the upper annular cap section 18. A water flow deflector 36 is inserted into the portion 33 and has an upper conical portion 37 which is molded as an integral part of an annular channel portion 39 defining an upwardly facing annular chamber 42. A plurality of circumferentially spaced ports 44 extend tangentially through the inner wall of the channel portion 39. When pressurized water flows through the fitting 28 into an upper chamber 47 within the housing section 18 and into the annular chamber 42, the water then flows inwardly through the ports 44 for rotating a turbine wheel 52 mounted on the input shaft of a gear reducer box or unit 55. The gear reducer unit 55 is known in the field of pulsating shower heads and includes a cylindrical housing 56 enclosing a series of molded plastic gears (not shown) which provide a reduction ratio of about 400 to 1 between rotation of the turbine wheel 52 on the input shaft and the rotation of an output shaft 58. A reduced lower end portion of the housing 56 seats within a counterbore of a circular valve body 64 which slides into the housing section 32 during assembly. A resilient O-ring 66 forms a water-tight seal between the housing section 32 and the valve body 64 and separates an annular water chamber 68 surrounding the gear reducer unit 55 and a chamber 72 within the valve body 64.

The valve body 64 has an axially extending hole 74 (FIG. 4) which receives water flowing from the bottom of the turbine wheel 52 and through the annular chamber 68. A radially extending port 76 connects the hole 74 to a chamber 78 defined by the valve body 64 and receiving the output shaft 58 of the gear reducer unit 55.

Figure 4:
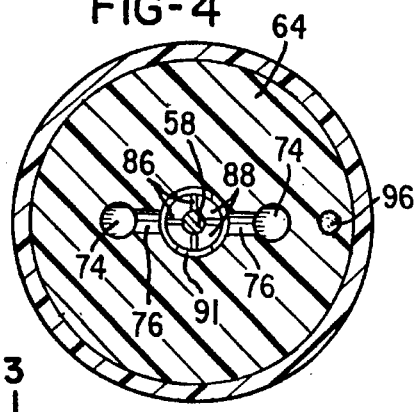
FIG. 4 is a section taken generally on the line 4—4 of FIG. 2.

An inverted cup-shaped cylindrical valve member 82 is secured to the output shaft 58 of the gear reducer unit 55 and rotates within the chamber 78 which extends into a lower cup-shaped portion 84 of the valve body 64. As shown in FIG. 4, the upper portion of the valve member 82 has a set of spoke-like ribs 86 which define therebetween water flow passages 88. The valve member 82 also has a set of two diametrically opposed ports 91 (FIG. 4), and the lower portion of the valve housing 64 has a radial port 93. The ports 91 within the valve member 82 are sufficiently large so that the port 93 is always at least partially open to one of the ports 91.

As the water flows inwardly through the ports 76 within the valve body 64 and downwardly into the rotating valve member 82 through the passages 88, the water flows outwardly through the ports 91 and 93 in a variable flow rate which varies from a full flow rate to a very low flow rate into the chamber 72. The valve body 64 also includes an axially extending by-pass passage 96 (FIGS. 2 & 4) through which water may flow from the chamber 68 rather than through the rotating valve member 82. When a full variable flow rate is desired, the passage 96 is closed by manually rotating a cross valve shaft 100 which is rotatably supported by a cylindrical valve body 102 inserted into a counterbore within the housing section 32. The valve shaft 100 has a diametrically extending port 104 which may be aligned with a passage 105 within the valve body 102 and forming an extension of the passage 96. A cap-like knob 106 is secured to the outer end portion of the valve shaft 100 by a lock screw 107, and a pair of resilient O-rings 108 form water-tight seals between the valve body 102 and the opposite end portions of the valve shaft 100. When the knob 106 is rotated from the position shown in FIG. 2, the port 104 aligns with the passages 96 and 105 and permits a direct flow of water from the chamber 68 through the chamber valve bodies 64 and 102. When the knob 106 is rotated to the position shown in FIG. 2, all of the water flowing through the chamber 68 must flow through the rotating valve member 82 which produces cycling of the flow rate. The degree of flow rate cycling may be controlled by rotating the knob 106 to change the proportion of the water flowing through the passages 93 and 96.

The lower portion 84 of the valve body 64 projects into a center cavity within the top of the valve body 102 and has a center hole 110 which aligns with a port 112 within the valve shaft 100 and a port 113 within the valve body 102 when the valve shaft 100 is rotated. The valve shaft 100 also has a radial port 114 which aligns with a passage 116 within the valve body 102 when the valve shaft 100 is rotated to permit water to flow from the chamber 72 into an annular chamber 118 formed within a bottom housing cap member 120 threaded onto the lower end portion of the housing section 32. A set of circumferentially spaced directional ports 123 (FIGS. 2 & 7) extend tangentially through an annular wall of the bottom cap member 120 for directing the water flowing into the annular chamber 118 inwardly into a circular turbine chamber 126 defined by the lower cap member 120.

Figure 2:
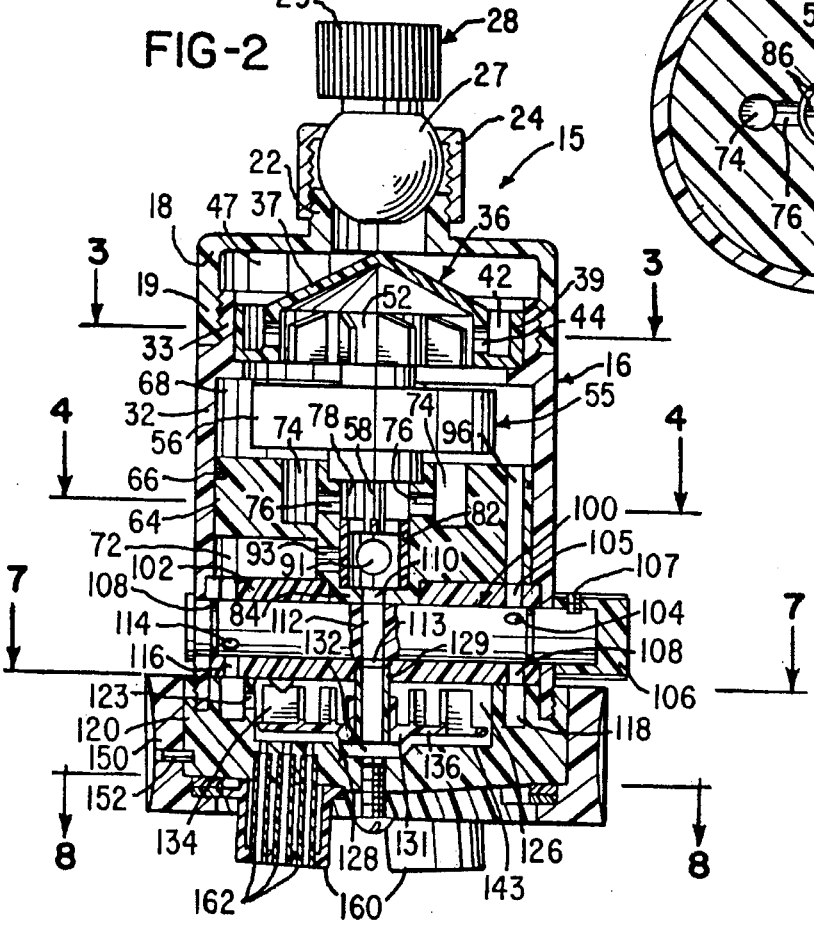
FIG. 2 is an axial section of the shower head shown in FIG. 1.
Figure 7:
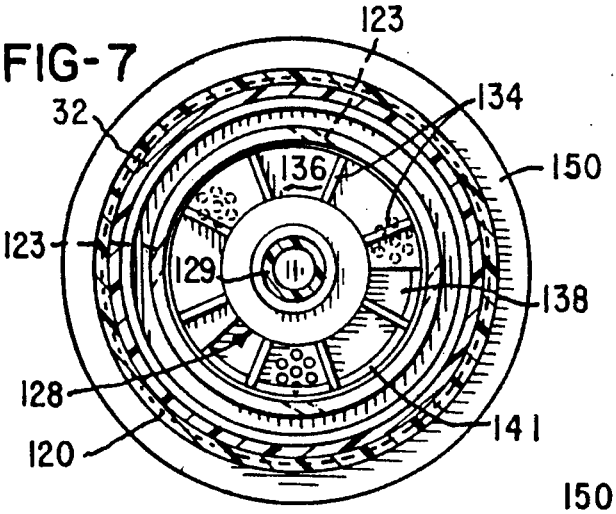
FIG. 7 is a section taken generally on the line 7—7 of FIG. 2.

A turbine wheel valve member 128 is rotatably supported within the chamber 126 by a tubular shaft 129 projecting downwardly from the valve body 102 and forming a continuation of the port 113. The turbine wheel valve member 128 has a bottom tapered hub 131 which projects into a tapered cavity 132 and includes a series of peripherally spaced radially extending vanes 134. The vanes 134 are impinged by the water streams flowing through the directional ports 123 for rotating the valve member 128 within the chamber 126. Referring to FIGS. 2 & 7, the turbine wheel valve member 128 has a flat annular bottom wall 136 which defines an arcuate opening 138 extending approximately 135°. The radial vanes 134 within the opening 138 are rigidly connected by a peripherally extending bottom ring 141. When the valve member 128 is rotating, the bottom wall 136 of the valve member 128 rotates with a very slight clearance above a flat annular surface 143 (FIG. 2) within the bottom cap member 120.

A control ring 150 is supported for rotation by the bottom cap member 120 and is retained on the cap member by a pin 152 which projects radially inwardly through the ring 150 and into a circumferentially extending groove 153 (FIG. 5) within the cap member 120. A circular bottom plate 155 (FIG. 5) is confined within the control ring 150 and is positively secured to the cap member 120 by a center screw 156. A plurality of three cup-shaped discharge caps 160 (FIGS. 1, 2 & 5) have upper circular flanges 161 each of which is supported for rotation by mating counterbores within the cap member 120 and bottom plate 155. Each cap 160 supports the outer end portions of a plurality of seven flexible orifice tubes 162 which are preferably formed from sections of an extruded tube of plastics material such as polyethylene and having an inner diameter of about 5/64 inch. The inner end portions of the tubes 162 are confined within corresponding counterbores formed within the cap member 120, and each tube 162 defines a passage or orifice 166 which aligns with a corresponding hole or port 167 extending from the flat annular surface 143 of the cap member 120.

Figure 5:
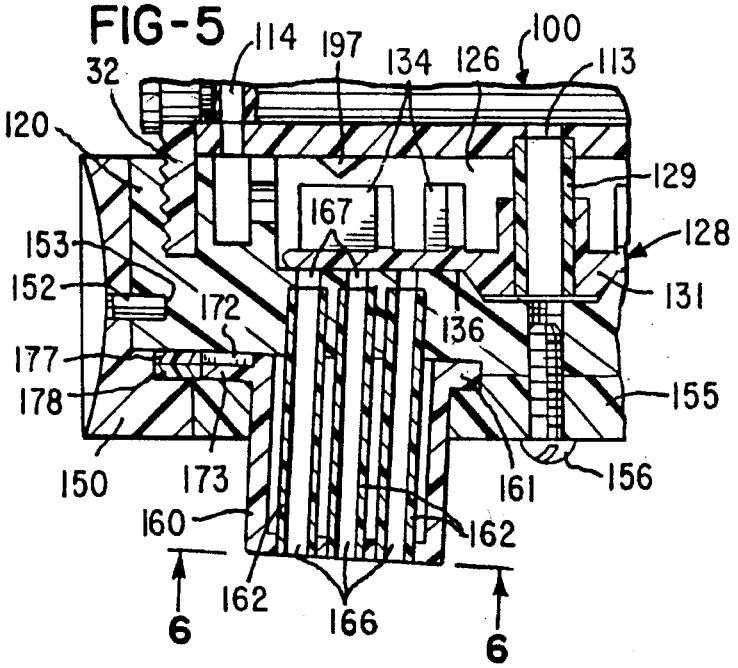
FIG. 5 is an enlarged fragmentary section of a portion of the shower head shown in FIG. 2.
Figure 6:
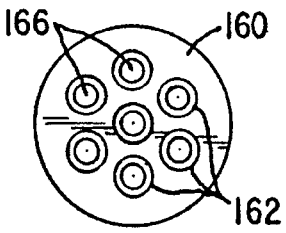
FIG. 6 is an end view of a group of discharge tubes, taken generally on the line 6—6 of FIG. 5.
Figure 8:
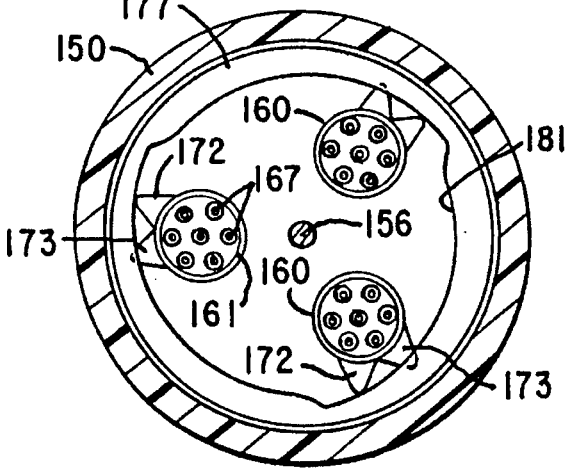
FIG. 8 is a section taken generally on the line 8—8 of FIG. 2.

Referring to FIG. 8, the upper flange 161 of each cap 160 includes a pair of outwardly projecting and peripherally-spaced triangular-shaped ears 172 and 173 with the ear 172 located above the ear 173 (FIG. 5). A set of two cam rings 177 and 178 are connected for rotation with the control ring 150, and the cam rings are positioned for engaging the ears 172 and 173, respectively, as shown in FIG. 5. Each of the cam rings has an inner cam surface 181 with the surface 181 on one cam ring being the reverse of the surface on the other cam ring. The surfaces 181 are effective to rotate the caps 160 through a few degrees in opposite directions in response to rotation of the control ring 150 and cam rings 177 and 178 in corresponding opposite directions through a substantially greater degree of rotation. As shown in FIG. 1, when each of the caps 160 rotates, the corresponding group of orifice tubes 162 are twisted for changing the spray pattern from each cap 160 between a concentrated or tight pattern 184 and a full or wide pattern 186. The spray patterns from all of the caps 160 simultaneously change in response to rotation of the control ring 150.

Referring to FIGS. 2 and 5, when the valve shaft 100 is rotated to a position where the port 112 connects the port 110 to the port 113, water flows downwardly through the tubular shaft 129 and hydraulically elevates the turbine valve member 128 on the shaft 129 until one of the vanes 134 engages a stop 197 (FIG. 5). This stops rotation of the elevated valve member 128 and allows the water to flow through the shaft 129 and outwardly under the bottom wall 136 of the turbine valve member and directly into the inlets or ports 167 for the orifice tubes 162. When the turbine valve member 128 is elevated and is blocked from rotating, there is no pulsation of the water streams flowing through the orifice tubes 162 so that all of the tubes receive a continuous flow of water.

From the drawings and the above description, it is apparent that a shower head constructed in accordance with the present invention, provides desirable features and advantages. As one feature, the cycling flow rate between a low flow rate such as 2.25 gallons per minute and a high flow rate such as 3 gallons per minute, as produced by the rotating valve member 82, provides a significant water savings as well as the advantage of a high flow rate several times a minute. Another feature is provided by the water pulsation produced by the rotating turbine valve member 128 and which may be combined with the cycling feature to provide cycling pulsation between low flow and slower pulsations and a high flow and faster pulsations. This combination provides a distinctive massaging action which is not obtained by only pulsation at a constant frequency. The adjustable rotation of the caps 160 and the corresponding twisting of the groups of orifice tubes 162 further provides for adjusting the spray pattern infinitely between a concentrated and more penetrating pattern and a full wide spray pattern when a more delicate pulsating action is desired. In addition, the control knob 106 and valve shaft 100 provide for selecting between full pulsation without cycling and full flow without cycling or pulsation.

While the form of shower head herein described constitutes a preferred embodiment of the invention, it is to be understood that the invention is not limited to this precise form of shower head, and that changes may be made therein without departing from the scope and spirit of the invention as defined in the appended claims.

The invention having thus been described, the following is claimed:

1. A shower head assembly comprising a housing, means including a plurality of orifices for directing water flowing from said housing in water streams forming spray, means including a rotary turbine wheel cooperating with said orifices for pulsating the water streams, and control means for hydraulically shifting said turbine wheel axially to a non-pulsating position.

2. A shower head assembly as defined in claim 1 and including a tubular shaft supporting said turbine wheel for axial movement between a pulsating position and said non-pulsating position, and a manually actuated control valve connected to direct water through said tubular shaft for shifting said turbine wheel axially from said pulsating position to said non-pulsating position.

3. A shower head assembly as defined in claim 1 and including a rotary valve member within said housing and driven by a speed reducer for continuously varying the flow rate of the pulsating water streams discharged from said housing between high and low flow rates to produce a cycling flow rate.

4. A shower head assembly as defined in claim 3 and including a passage within said housing for by-passing water around said rotary valve member, and a manually controlled valve within said passage.

5. A shower head assembly as defined in claim 1 and including a plurality of orifice tubes and a tube support member supporting corresponding end portions of said orifice tubes, means supporting said tube support member for rotation, and a control member connected to rotate said support member for simultaneously twisting all of said orifice tubes as a unit.

6. A shower head assembly comprising a housing, means for directing water into said housing, flexible body means defining a plurality of orifices for directing water from said housing in water streams forming a spray, and a control member connected to twist said flexible body means on an axis for infinitely changing the pattern of the spray between a relatively tight penetrating pattern and a wide full pattern.

7. A shower head assembly comprising a housing, a rotary valve member within said housing speed reducing, drive means for rotating said valve member in response to a flow of water through said housing, means for directing the water flowing through said housing through said valve member and for automatically and continuously varying the flow rate between high and low flow rates to produce a cycling flow rate, means for directing the water from said housing in a plurality of water streams forming a spray, means including a water activated rotary turbine wheel within said housing downstream of said rotary valve member for pulsating the water streams discharged from said housing while the flow rate of the water streams is cycling between said high and low flow rates, and means for moving said turbine wheel axially to a non-pulsating position for producing continuous water streams which cycle between said high and low flow rates.

8. A shower head assembly as defined in claim 7 and including a by-pass passage within said housing for by-passing water around said rotary valve member, and a manually rotatable valve member extending from said housing and defining a port for controlling the flow of water through said by-pass passage.

9. A shower head assembly as defined in claim 7 and including means for infinitely changing the spray pattern between a relatively tight penetrating pattern and a wide full pattern.

10. A shower head assembly comprising a housing, a rotary valve member within said housing, a water activated rotary turbine wheel supported within said housing, a speed reducing drive connecting said turbine wheel to said valve member for rotating said valve member at a substantially slower speed than the speed of said turbine in response to the flow of water through said housing, a passage for directing the water flowing through said housing through said valve member while said valve member is rotating at said substantially slower speed for automatically and continuously varying the flow rate between high and low flow rates to produce a cycling flow rate, and body means defining a plurality of orifices for discharging water flowing through said housing in water streams forming a spray pattern.

11. A shower head assembly as defined in claim 10 and including a passage within said housing for by-passing water around said rotary valve member, and a manually controlled valve within said passage.

12. A shower head assembly as defined in claim 10 and including means for infinitely changing the spray pattern between a relatively tight penetrating pattern and a wide full pattern.

13. A shower head assembly as defined in claim 10 and including means within said housing for pulsating the water streams discharged from said orifices while the flow rate is cycling.

14. A shower head assembly as defined in claim 10 and including flexible said body means defining said orifices, and means for twisting said body means for infinitely changing the spray pattern.

15. A shower head assembly as defined in claim 14 wherein said body means define spaced groups of said orifices, and a control member connected to twist said body means for simultaneously and infinitely changing the spray pattern.

* * * * *